US007907856B2

(12) United States Patent
Tsukamoto et al.

(10) Patent No.: US 7,907,856 B2
(45) Date of Patent: Mar. 15, 2011

(54) DEVELOPMENT APPARATUS AND IMAGE FORMING APPARATUS USING TONER CARRIER WITH A PLURALITY OF ELECTRODES

(75) Inventors: Takeo Tsukamoto, Kanagawa (JP); Nobuaki Kondoh, Kanagawa (JP); Masanori Horike, Kanagawa (JP); Tomoko Takahashi, Kanagawa (JP); Masaaki Yamada, Tokyo (JP); Hideki Kosugi, Kanagawa (JP); Ichiro Kadota, Kanagawa (JP); Yoshinori Nakagawa, Kanagawa (JP); Yasuyuki Ishii, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 896 days.

(21) Appl. No.: 11/546,251

(22) Filed: Oct. 12, 2006

(65) Prior Publication Data

US 2007/0086811 A1 Apr. 19, 2007

(30) Foreign Application Priority Data

Oct. 13, 2005 (JP) ..... 2005-299082
Sep. 29, 2006 (JP) ..... 2006-266496

(51) Int. Cl.
*G03G 15/06* (2006.01)
*G03G 15/08* (2006.01)

(52) U.S. Cl. ..... 399/55; 399/266; 399/291

(58) Field of Classification Search ..... 399/55, 399/265, 266, 270, 285, 290, 291; 430/123.2, 430/123.3

See application file for complete search history.

(56) References Cited

U.S. PATENT DOCUMENTS 4,558,941 A * 12/1985 Nosaki et al. ..... 399/266
5,360,940 A 11/1994 Hays
5,394,225 A 2/1995 Prker
5,448,342 A * 9/1995 Hays et al. ..... 399/285
5,594,534 A 1/1997 Genovese
5,729,807 A * 3/1998 Parker ..... 399/285
5,835,829 A * 11/1998 Genovese et al. ..... 399/285
6,597,884 B2 7/2003 Miyaguchi et al.
6,658,227 B2 12/2003 Oyama et al.

(Continued)

FOREIGN PATENT DOCUMENTS

EP 0 106 322 A1 4/1984

(Continued)

OTHER PUBLICATIONS

U.S. Appl. No. 12/261,.302, filed Oct. 30, 2008, Kosugi, et al.

(Continued)

*Primary Examiner* — Robert Beatty
(74) *Attorney, Agent, or Firm* — Oblon, Spivak, McClelland, Maier & Neustadt, L.L.P.

(57) ABSTRACT

An apparatus for developing a latent image on a latent image carrier includes a toner carrier and multiple electrodes arranged at intervals on a surface of the toner carrier. A potential difference is formed between even-numbered electrodes and odd-numbered electrodes of the electrodes by applying a first pulse voltage to the even-numbered electrodes and a second pulse voltage to the odd-numbered electrodes so that toner on the surface of the toner carrier moves back and forth between the electrodes, where the first and second pulse voltages are in different phases, and the toner moving back and forth between the electrodes is conveyed to a position facing the latent image carrier by movement of the surface of the toner carrier and thereby caused to adhere to the latent image on the latent image carrier.

20 Claims, 14 Drawing Sheets

U.S. PATENT DOCUMENTS

| | | | | |
|---|---|---|---|---|
| 6,708,014 | B2 | 3/2004 | Miyaguchi et al. | |
| 6,901,231 | B1 * | 5/2005 | Sakai et al. | 399/266 |
| 6,941,098 | B2 | 9/2005 | Miyaguchi et al. | |
| 6,947,691 | B2 | 9/2005 | Miyaguchi et al. | |
| 7,024,142 | B2 | 4/2006 | Sakai et al. | |
| 7,062,204 | B2 | 6/2006 | Miyaguchi et al. | |
| 7,079,798 | B2 | 7/2006 | Suzuki et al. | |
| 2004/0240907 | A1 | 12/2004 | Miyaguchi et al. | |
| 2005/0025525 | A1 | 2/2005 | Horike et al. | |
| 2005/0158073 | A1 | 7/2005 | Nakazato et al. | |
| 2005/0265751 | A1 | 12/2005 | Nakazato et al. | |
| 2005/0286916 | A1 | 12/2005 | Nakazato et al. | |
| 2006/0013604 | A1 | 1/2006 | Kadota et al. | |
| 2006/0088337 | A1 | 4/2006 | Nakazato et al. | |
| 2006/0120765 | A1 | 6/2006 | Sakai et al. | |
| 2006/0182451 | A1 | 8/2006 | Shoji et al. | |
| 2006/0210320 | A1 | 9/2006 | Nakagawa et al. | |
| 2006/0216071 | A1 | 9/2006 | Yamada et al. | |
| 2007/0086811 | A1 | 4/2007 | Tsukamoto et al. | |

FOREIGN PATENT DOCUMENTS

| | | | |
|---|---|---|---|
| GB | 1 458 766 | | 12/1976 |
| JP | 59-7972 | | 1/1984 |
| JP | 60-61774 | | 4/1985 |
| JP | 61-4071 | | 1/1986 |
| JP | 3-21967 | | 1/1991 |
| JP | 3-100575 | | 4/1991 |
| JP | 3-113474 | | 5/1991 |
| JP | 9-269661 | | 10/1997 |
| JP | 2002-341656 | | 11/2002 |
| JP | 2002-365912 | | 12/2002 |
| JP | 2003-15419 | | 1/2003 |
| JP | 2003005524 | A * | 1/2003 |
| JP | 2003-84560 | | 3/2003 |
| JP | 2004-286837 | | 10/2004 |

OTHER PUBLICATIONS

U.S. Appl. No. 11/621,873, filed Jan. 10, 2007, Kosugi et al.
U.S. Appl. No. 12/042,892, filed Mar. 5, 2008, Tsukamoto, et al.
U.S. Appl. No. 12/121,122, filed May 15, 2008, Kadota et al.
U.S. Appl. No. 12/140,032, filed Jun. 16, 2008, Ishii, et al.
U.S. Appl. No. 12/170,930, filed Jul. 10, 2008, Takahashi, et al.
U.S. Appl. No. 12/176,054, filed Jul. 18, 2008, Kadota, et al.
U.S. Appl. No. 12/205,314, filed Sep. 5, 2008, Nakagawa, et al.
U.S. Appl. No. 12/205,240, filed Sep. 5, 2008, Takahashi, et al.
U.S. Appl. No. 11/546,251, filed Oct. 12, 2006, Tsukamoto et al.
U.S. Appl. No. 11/621,873, filed Jan. 10, 2007, Kosugi et al.
U.S. Appl. No. 11/376,434, filed Mar. 16, 2006, Tomoko Takahashi, et al.
U.S. Appl. No. 12/176,054, filed Jul. 18, 2008, Kadota, et al.

* cited by examiner

DEVELOPMENT APPARATUS AND IMAGE FORMING APPARATUS USING TONER CARRIER WITH A PLURALITY OF ELECTRODES

BACKGROUND OF THE INVENTION

1. Field of the Invention

The present invention generally relates to a development apparatus and an image forming apparatus, and more particularly relates to a development apparatus and an image forming apparatus such as a copier, a printer, or a facsimile that forms an image using the development apparatus.

2. Description of the Related Art

Some development apparatuses convey toner using a toner carrier such as a toner conveying base plate that causes toner to hop from one electrode to another, instead of using a developing roller or a magnetic carrier that attracts toner.

For example, a development apparatus disclosed in patent document 1 includes a cylindrical toner carrier having multiple electrodes arranged at a certain pitch in the circumferential direction. The electrodes are made up of multiple pairs of adjacent electrodes. Between each pair of adjacent electrodes an alternating electric field is formed. The alternating electric field causes toner on a first electrode of each pair of adjacent electrodes to float and land on a second electrode, or causes toner on the second electrode to float and land on the first electrode (this phenomenon is hereafter called hopping). The toner that continues hopping on the cylindrical toner carrier is conveyed to a development area as the cylindrical toner carrier rotates. In the development area, toner floating near a latent image on a latent image carrier does not come down to the electrodes on the toner carrier, but instead is attracted by electric fields of the latent image and adheres to the latent image. In such a development apparatus, toner hopping on a toner carrier (not adhering to the toner carrier) is used for development instead of toner adhering to a developing roller or a magnetic carrier. This mechanism makes it possible to develop a latent image with a very low voltage, which is not possible with a conventional single- or two-component development method. For example, it becomes possible to make toner adhere to an electrostatic latent image with a potential difference as low as several tens of volts from surrounding non-image areas.

[Patent document 1] Japanese Patent Application Publication No. 3-21967

In the exemplary development apparatus disclosed in patent document 1, an alternating voltage is applied to the electrodes of the toner carrier to form alternating electric fields. Although there is no detailed description in patent document 1 about the alternating voltage to be applied, judging from the configuration of the exemplary development apparatus shown in FIG. 2 in patent document 1, it is assumed that an alternating voltage of one pulse wave, for example, from a 100 V AC power supply widely used in homes is used. Also, as shown in FIG. 16, one of each pair of electrodes is grounded and an alternating voltage with frequency f is applied to the other one.

According to an experiment by the inventors of the present invention, applying an alternating voltage in a manner as described above may cause scumming (smear) on a non-image area (where no latent image is formed) of a latent image carrier. To develop a latent image at high quality with a cloud of toner, it is necessary to form an even toner cloud by causing toner to smoothly hop between electrodes. In the alternating voltage applying method as shown in FIG. 16, the electrostatic force that causes toner to hop between electrodes is generated by the potential difference between a half of the peak-to-peak voltage Vpp at the first electrode to which a pulse wave is applied and 0 volts at the second electrode that is grounded. To increase the electrostatic force and thereby to cause smooth hopping of toner, it is necessary to increase the amplitude of the peak-to-peak voltage Vpp of the pulse wave. However, when the amplitude is increased to the extent necessary to cause smooth hopping, at the upper peak or the lower peak of the pulse wave voltage, electric fields that attract toner on the electrodes to the non-image area of the latent image carrier may be formed for a moment. In other words, when the pulse wave voltage reaches the upper peak or the lower peak, toner may be attracted to the non-image area.

SUMMARY OF THE INVENTION

The present invention provides a development apparatus and an image forming apparatus that substantially obviate one or more problems caused by the limitations and disadvantages of the related art.

Embodiments of the present invention provide a development apparatus and an image forming apparatus using a toner hopping technique that can prevent scumming.

According to an embodiment of the present invention, an apparatus for developing a latent image on a latent image carrier includes a toner carrier and multiple electrodes arranged at intervals on a surface of the toner carrier, wherein a potential difference is formed between even-numbered electrodes and odd-numbered electrodes of the electrodes by applying a first pulse voltage to the even-numbered electrodes and a second pulse voltage to the odd-numbered electrodes so that toner on the surface of the toner carrier moves back and forth between the electrodes, where the first and second pulse voltages are in different phases; and the toner moving back and forth between the electrodes is conveyed to a position facing the latent image carrier by movement of the surface of the toner carrier and thereby caused to adhere to the latent image on the latent image carrier.

An embodiment of the present invention provides an image forming apparatus that includes an apparatus for developing a latent image on a latent image carrier as described above.

DESCRIPTION OF THE PREFERRED EMBODIMENTS

Figure 1:
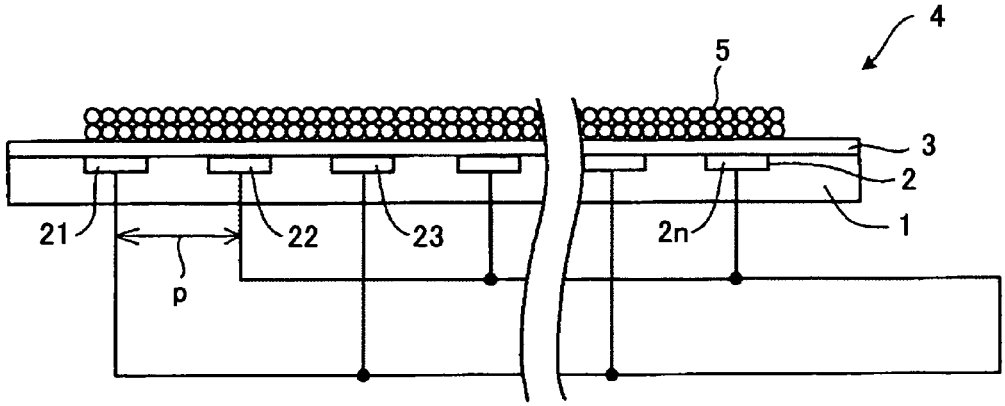
FIG. 1 is a schematic drawing of a system used in experiments relating to the present invention.

Preferred embodiments of the present invention are described below with reference to the accompanying drawings.

An experiment relating to the present invention is described below. In a system shown in FIG. 1, a base plate 4 used as a toner carrier includes a glass base plate 1, an electrode pattern 2 including electrodes 21 through 2*n* formed on the glass base plate 1 by aluminum vapor deposition at p μm pitch in the direction of movement, and a surface layer 3 formed on the electrode pattern 2 which surface layer 3 has a thickness of about 3 μm and is made of a resin with a volume resistivity of about $10^{10}$ Ωcm. A charged toner layer 5 is formed on the base plate 4.

Figure 2:
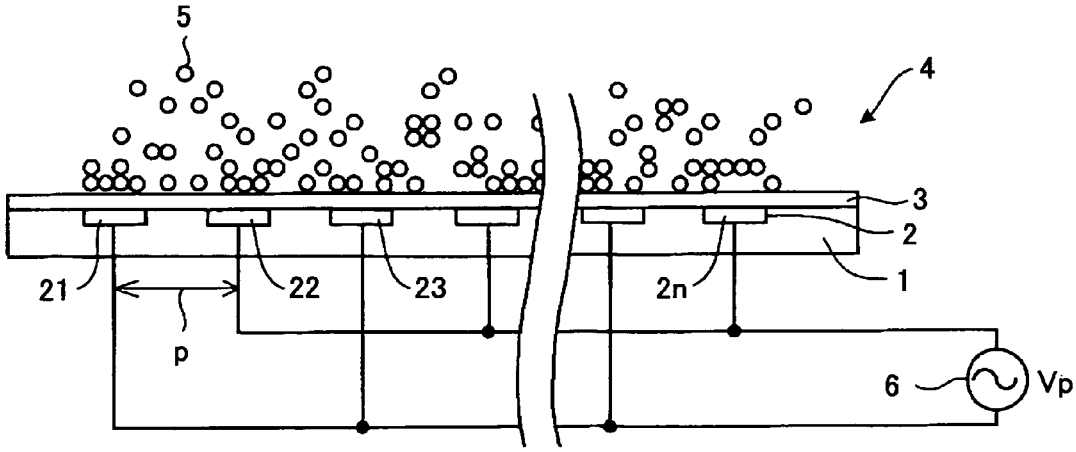
FIG. 2 is a schematic drawing of the system shown in FIG. 1 where a toner flare is formed.

The toner layer 5 is formed as a thin layer of toner on the base plate 4 by developing a solid-color image with a two-component developer unit (not shown). Toner particles used for the toner layer 5 are made of polyester and have a diameter of about 6 μm. The amount of charge of the toner on the base plate 4 was about −22 μC/g. As shown in FIG. 2, when an alternating voltage is applied to odd numbered electrodes (21, 23, . . . ) and an alternating voltage in opposite phase is applied to even numbered electrodes (22, . . . ) from an AC power supply 6, the toner of the toner layer 5 moves back and forth between the odd numbered electrodes and the even numbered electrodes. This phenomenon is hereafter called a toner flare or toner is flaring.

Figure 3:
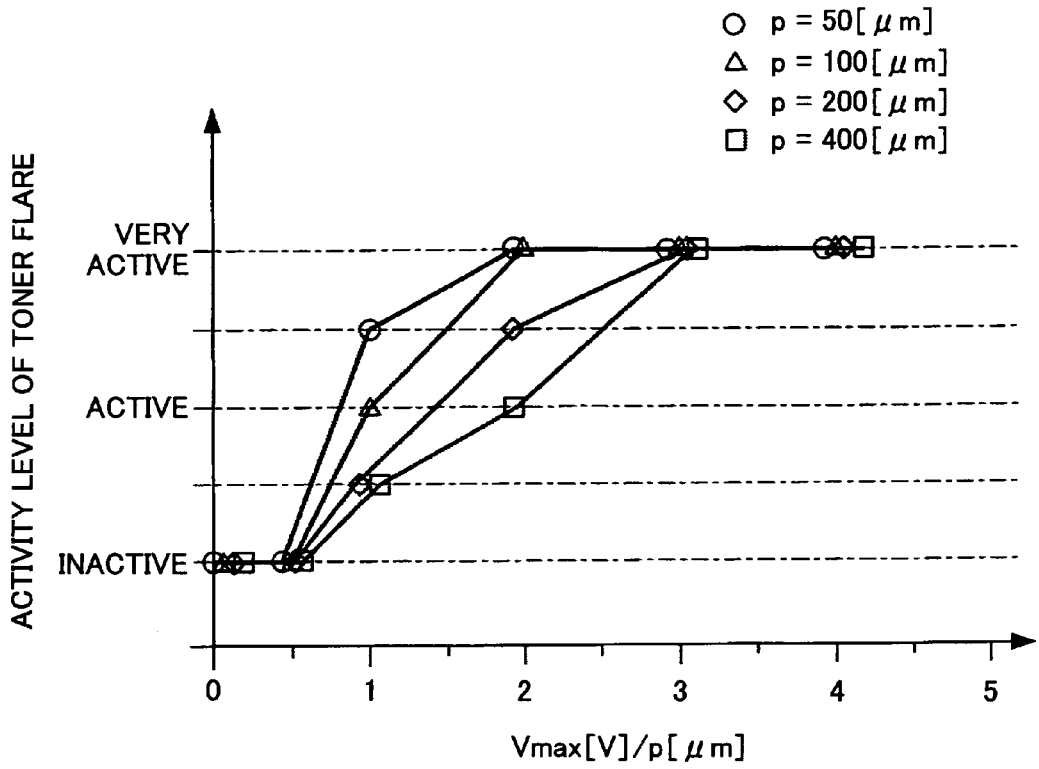
FIG. 3 is a graph showing the results of an experiment where the relationship between Vmax [V]/p [μm] and the activity levels of a toner flare was observed.

In an experiment shown in FIG. 3, four types of the base plates 4 having electrodes 21 through 2*n* formed at 50, 100, 200, and 400 μm pitch, respectively, were used. In the experiment, the activity levels of toner flares were observed with a high-speed camera while changing Vmax [V] that is the absolute value of the difference between a positive peak value and a negative peak value of the alternating voltage applied to the electrodes 21 through 2*n* from the AC power supply 6. The width of each of the electrodes 21 through 2*n* and the distance between them were determined so as to become a half of the pitch between each adjacent pair of the electrodes 21 through 2*n*.

The activity levels of toner flares were measured based on a five-point scale sensory evaluation by observing toner unmoving and adhering to the surface of the base plate 4. The results in FIG. 3 indicate that the activity level of a toner flare can be determined almost solely by the value of Vmax [V]/p [μm] regardless of the individual values of Vmax and p. When Vmax [V]/p [μm] exceeds 1, toner flares start to become active. When Vmax [V]/p [μm] is larger than 3, toner flares are completely active.

Figure 4:
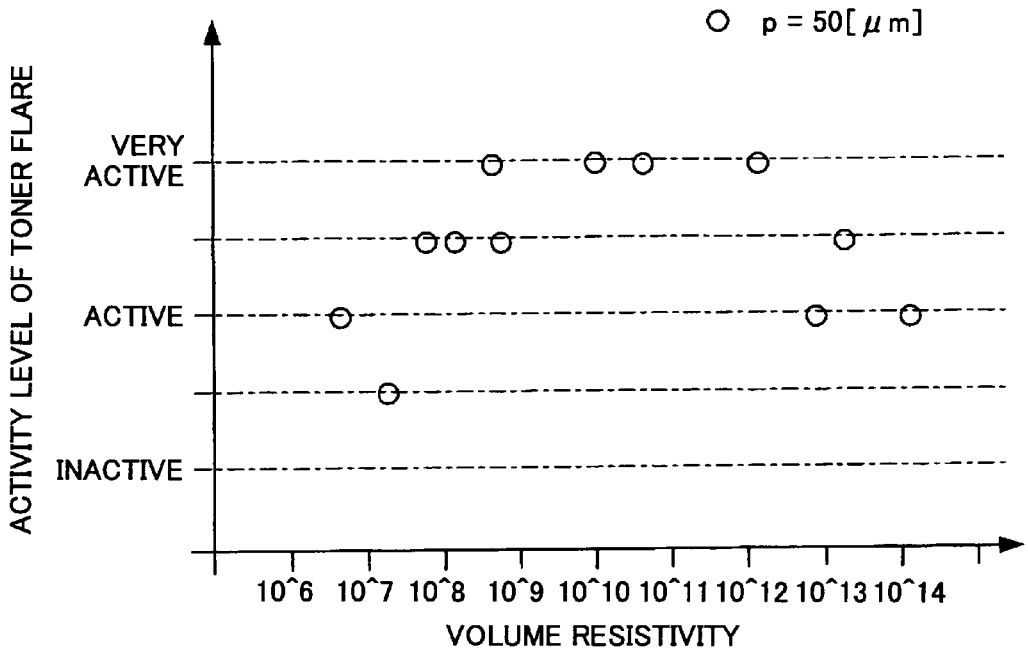
FIG. 4 is a graph showing the results of an experiment where the relationship between the volume resistivity of a surface layer 3 and the activity levels of a toner flare was observed.

In an experiment shown in FIG. 4, to determine the influence of electrical characteristics of the surface of the base plate 4, the activity levels of toner flares were observed with a high-speed camera while changing the volume resistivity of the surface layer 3 of the base plate 4. The volume resistivity of the surface layer 3 (with a thickness of about 5 μm) was changed within the range of between $10^7$ and $10^{14}$ Ωcm by varying the amount of carbon microparticles dispersed in the silicon resin material of the surface layer 3. In this experiment, the base plate 4 having electrodes 21 through 2*n* formed at 50 μm pitch was used.

Figure 11:
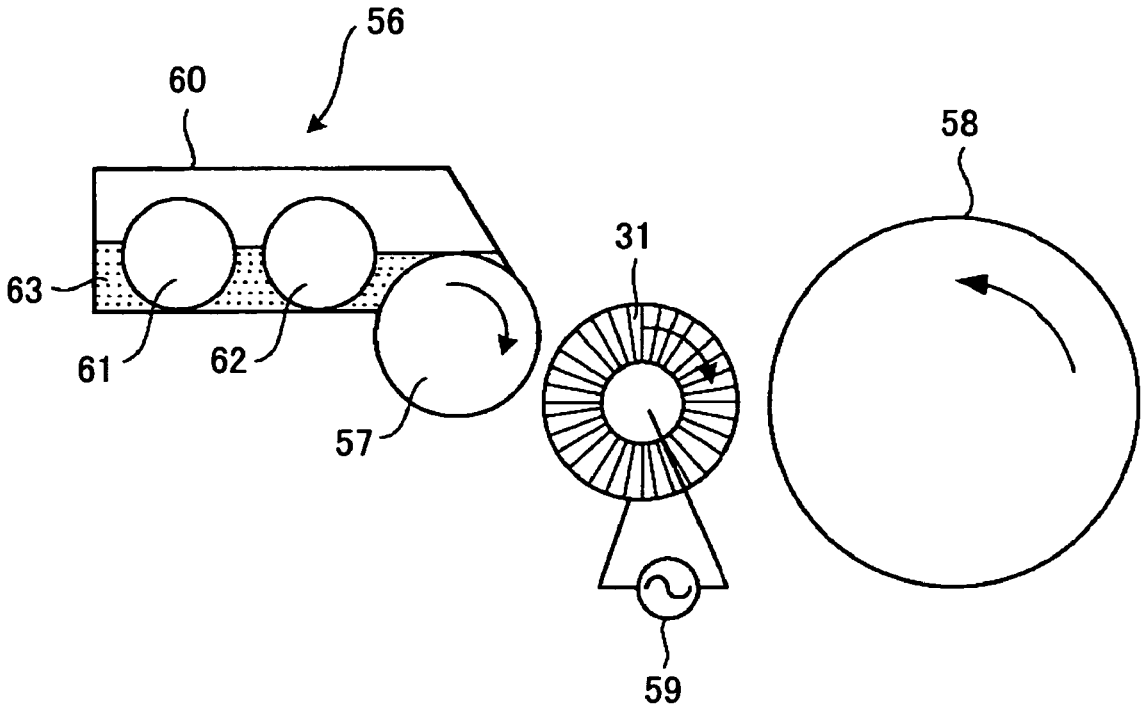
FIG. 11 is a schematic drawing of an exemplary image forming apparatus according to an embodiment of the present invention.

The results in FIG. 4 indicate that the optimum range of the volume resistivity of the surface layer 3 is between $10^9$ and $10^{12}$ Ωcm. When the surface layer 3 has a very high volume resistivity, the friction between actively moving toner and the surface layer 3 continuously charges the surface of the base plate 4 and causes the surface potential of the base plate 4 to vary, thereby making the bias that affects the quality of image development unstable. When the conductivity of the surface layer 3 is too high, leaks of charges (short) occur between the electrodes 21 through 2*n*, and as a result, it becomes difficult to obtain a sufficient bias effect. The volume resistivity of the surface layer 3 is preferably between $10^9$ and $10^{12}$ Ωcm so that charges accumulated on the surface of the base plate 4 can smoothly move to the electrodes 21 through 2*n*. The preferable range of the volume resistivity mentioned above was obtained by an experiment performed in an experiment facility using the system shown in FIG. 2. When a development apparatus having a developing roller as shown in FIG. 11 is used instead of the system shown in FIG. 2, the preferable range of the volume resistivity may change. In such a case, it is preferable to determine the preferable range of the volume resistivity for the development apparatus and adjust the volume resistivity accordingly.

In another experiment to determine the influence of frictional charge characteristics of the surface of the base plate 4, the activity levels of toner flares were observed with a high-speed camera using two types of the base plates 4, one having the surface layer 3 made of a silicon resin and the other having the surface layer 3 made of a fluororesin. A small amount of carbon microparticles are mixed in the materials of the surface layers 3 of both types of the base plates 4 to provide volume resistivity of between $10^{11}$ and $10^{12}$ Ωcm. An alternating bias was applied from the A/C power supply 6 to the electrodes 21 through 2*n* to observe the activity levels of toner flares. On the surface layer 3 made of a silicon resin, a toner flare was observed for a long period of time. On the surface layer 3 made of a fluororesin, a toner flare ceased after a short period of time and toner became inactive on the base plate 4.

After the observation, the amount of charge of the toner on each of the base plates 4 was measured. The amount of charge of the toner on the surface layer 3 made of a silicon resin decreased slightly from its initial value. The charge of the toner on the surface layer 3 made of a fluororesin almost disappeared. Experimentally, uncharged toner was rubbed against the surface layers 3. On the surface layer 3 made of a silicon resin, the toner assumed a frictional charge of positive polarity. On the surface layer 3 made of a fluororesin, the toner assumed almost no frictional charge but became slightly negative. Since toner collides with the surface of the base plate 4 a countless number of times during a toner flare, the surface layer 3 is preferably made of a material that can positively charge the toner rather than a material that discharges the toner. Such characteristics of a material depend on the frictional charge order of the material. For example, a glass material or a material used for coating the carriers of two-component developer is preferably used for the surface layer 3.

Figure 5:
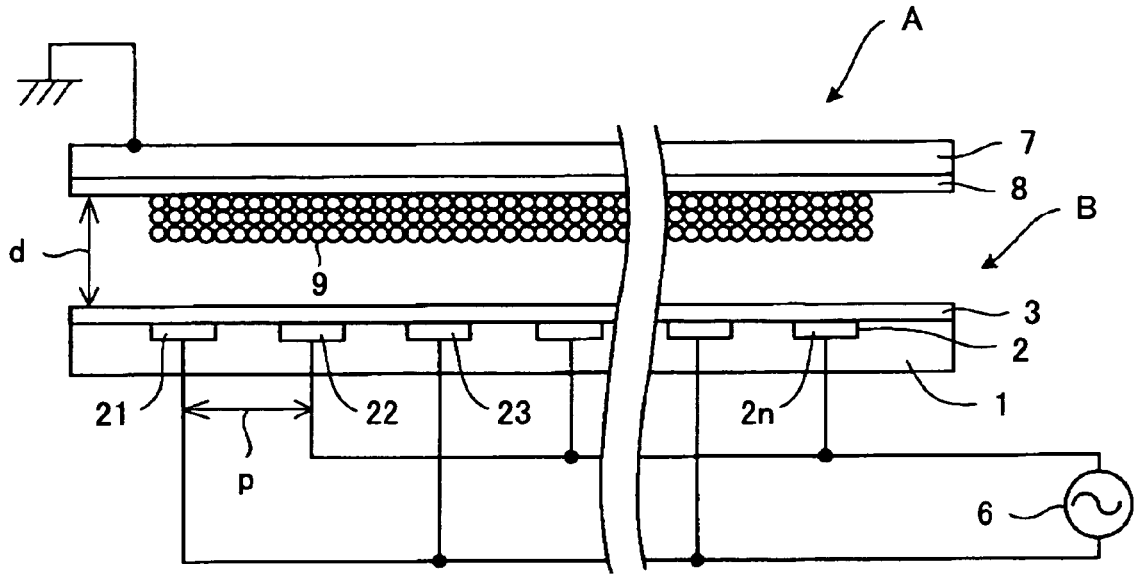
FIG. 5 is a schematic drawing of another system used in an experiment relating to the present invention.

FIG. 5 is a cross-sectional view of another system used in an experiment relating to the present invention. In FIG. 5, a base plate A includes a base plate 7 made of aluminum and a resin layer 8 (functions as a photoconductor) having a thickness of about 20 μm and formed on the base plate 7. The base plate 7 is grounded and a toner layer 9 with a density of 0.4 $mg/cm^2$ is formed on the resin layer 8. The toner layer 9 is formed on the resin layer 8 by developing a solid-color image with a two-component developer unit (not shown).

Figure 6:
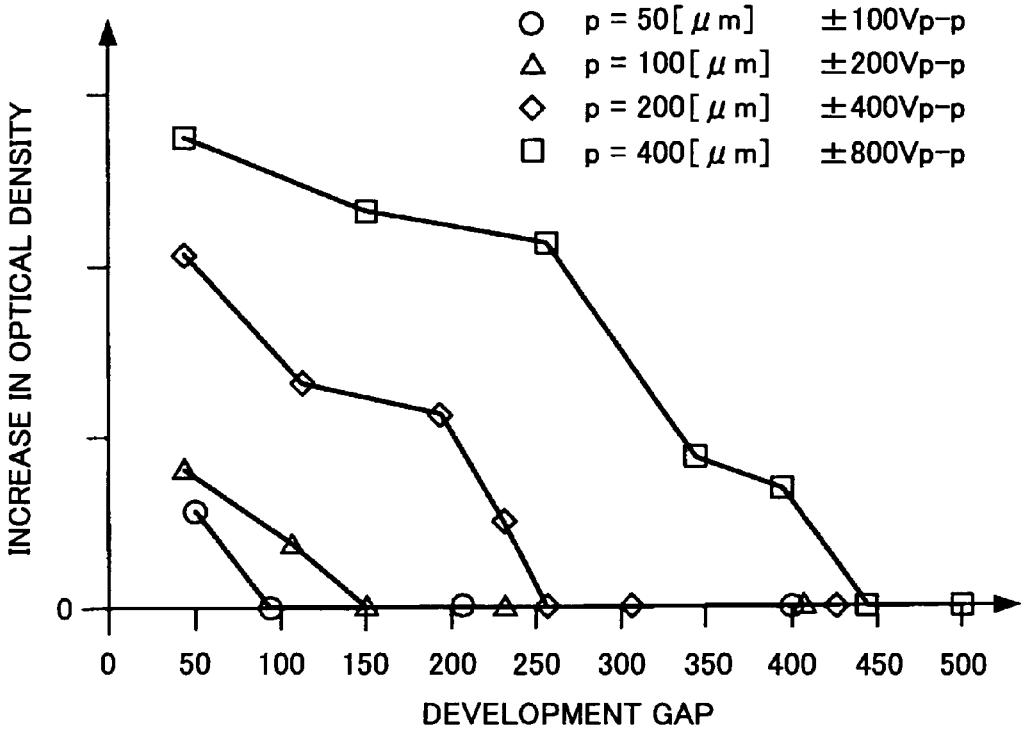
FIG. 6 is a graph showing the results of the experiment where the relationship between development gaps and the increase in optical density on a base plate B was observed.

A base plate B is positioned so as to face the base plate A with a distance of d μm between them. The base plate B has substantially the same structure as that of the base plate 4 shown in FIGS. 1 and 2. A white coating layer is used as a surface layer 3 so as to make it easier to measure, by an optical measurement device (reflection density measurement device), the amount of toner transferred onto the surface layer 3 in the steps described below. According to FIG. 3, a stable toner flare can be observed at Vmax [V]/p [μm]=4 regardless of the pitch between the electrodes 21 through 2*n*. In an experiment whose results are shown in FIG. 6, the relationship between development gaps (d [μm]) and the amounts of toner transferred onto the base plate B was observed using four conditions where Vmax [V]/p [μm]=4 is true. The vertical axis of a graph in FIG. 6 shows the increase in optical density on the surface layer 3 of the base plate B. When no toner is on the surface layer 3, the increase in optical density is 0. In the graph, the increase in optical density larger than 0 indicates that a part of the toner layer 9 on the resin layer 8 of the base plate A has been transferred to the surface layer 3 of the base plate B by an electric field formed on the base plate B. If such transfer of toner happens in an overlapping development process, a part of a toner layer formed on a latent image carrier (for example, a photoconductor) in a preceding image development may be removed, enter a development apparatus used for a succeeding image development, and thereby cause toners of different colors to mix. This may also disturb an image obtained in the preceding image development. To prevent the above problems, the increase in optical density must be 0. The results shown in FIG. 6 indicate that the pitch p between the electrodes 21 through 2*n* must be smaller than the development gap d ($p<d$) to keep the increase in optical density at 0.

From the results, it is assumed that, when the pitch between electrodes is smaller than a development gap, the electric field curtain formed on a toner carrier (base plate B) does not affect the electric field of an electrostatic latent image or a toner image on a latent image carrier (base plate A). Under such a condition, isolated dots can be accurately developed at resolutions of, for example, 1200 dpi and 2400 dpi without scavenging. Also, under such a condition, multiple layers of toner images of different colors can be formed accurately on a latent image carrier (base plate A) without disturbing preceding toner images and without causing toners of different colors to mix in a development apparatus.

Generally, a development apparatus using the two-component development method or the single-component development method is used in an image forming apparatus such as a copier, a printer, or a facsimile. The two-component development method is suitable for high-speed development and is a mainstream development method for medium-speed and high-speed image forming apparatuses. To produce a high-quality image by using the two-component development method, developer (toner+carrier particles) on a developer carrier (also called a toner carrier or developing roller) that develops an electrostatic latent image on a latent image carrier (such as a photoconductive drum) into a toner image must be very fine. For this reason, the diameter of carrier particles used in developer has been reduced and carrier particles with a diameter of about 30 μm are currently available for commercial use.

A development apparatus using the single-component development method is normally smaller and lighter than a development apparatus using the two-component development method. Therefore, the single-component development method is a mainstream development method for low-speed image forming apparatuses. In a development apparatus using the single-component development method, toner adhering to (not hopping on) a developer carrier such as a developing roller is used for development. A toner controlling part such as a blade or a roller is brought into contact with toner on the developing roller to form a thin layer of toner on the developing roller. By the friction with the developing roller and the toner controlling part, the toner is charged. The thin layer of charged toner formed on the developing roller is transferred to a latent image carrier and develops an electrostatic latent image on the latent image carrier. There are roughly two methods of transferring charged toner to a latent image carrier: contact-type and non-contact type. In a contact-type method, a developing roller is brought into contact with a latent image carrier. In a non-contact type method, a developing roller does not contact a latent image carrier.

To overcome disadvantages in each of two- and single-component development methods, several hybrid development methods that combine the advantages of the two methods have been proposed, for example, as disclosed in Japanese Patent Application Publication No. 3-100575.

Japanese Patent Application Publication No. 3-113474 discloses a development method that can form fine dots evenly at a high resolution. A development apparatus using the disclosed development method includes a wire to which a high-frequency bias is applied. The wire forms a toner cloud and thereby makes it possible to form dots at a high resolution.

Japanese Patent Application Publication No. 3-21967 discloses a method of forming an electric field curtain on a developing roller to efficiently form a stable toner cloud.

Japanese Patent Application Publication No. 2003-15419 discloses a development apparatus in which developer is carried by an electric field curtain of traveling wave electric fields. Japanese Patent Application Publication No. 9-269661 discloses a development apparatus including a developing roller having multiple magnetic poles on its surface which magnetic poles attract carrier particles and form a substantially even layer of carrier particles. Japanese Patent Application Publication No. 2003-84560 discloses a development apparatus including a toner carrier for carrying non-magnetic toner. On the surface of the toner carrier, conductive electrodes are formed at intervals with insulating parts between them. A certain bias potential is applied to the electrodes to generate an electric field gradient near the surface of the toner carrier and thereby to cause the non-magnetic toner to be attracted to the toner carrier.

There is an increasing demand for a higher image quality. To improve the quality of images or the reproducibility of isolated dots in a conventional development apparatus using the two-component development method, it is necessary to reduce the size of carrier particles and thereby to reduce the size of dots. However, reducing the diameter of carrier particles reduces magnetic permeability of the carrier particles and therefore such carrier particles easily come off the developing roller. The carrier particles that have come off the developing roller may adhere to a latent image carrier, degrade the image quality, and even damage the latent image carrier itself.

Manufacturers have been trying to prevent the above problem, for example, by improving the material of carrier particles and thereby increasing their magnetic permeability or by increasing the magnetic force of a magnet in a developing roller. However, they are facing difficulty in achieving both low costs and a high image quality. Also, because of downsizing, developing rollers are becoming smaller and smaller. Therefore, it is becoming more and more difficult to design a developing roller with a strong magnetic field that can prevent carrier particles from coming off.

In the two-component development method, a toner image is formed by rubbing a brush of two-component developer called a magnetic brush against an electrostatic latent image. Therefore, unevenness of the magnetic brush results in irregularity in development of isolated dots. Although image quality can be improved by forming alternating electric fields between a developing roller and a latent image carrier, such a measure cannot completely solve the problem of image irregularity caused by an uneven magnetic brush.

To improve the efficiency in a step of transferring a developed toner image on a latent image carrier or in a step of removing toner remaining on a latent image carrier after the transfer step, it is necessary to reduce the non-electrostatic adhesion force between the latent image carrier and toner as much as possible. One way to reduce the non-electrostatic adhesion force between a latent image carrier and toner is to reduce the friction coefficient of the surface of the latent image carrier. However, with a low friction coefficient, the brush of two-component developer slides too smoothly on the latent image carrier and, as a result, development efficiency and dot reproducibility are reduced.

In the single-component development method, since a thin layer of toner formed by a toner controlling part is pressed firmly onto a developing roller, the responsiveness of the toner to electric fields becomes very low. Therefore, to achieve a high image quality, strong alternating electric fields are normally formed between a developing roller and a latent image carrier. However, even with such strong alternating electric fields, it is difficult to evenly attract toner to an electrostatic latent image and to develop fine dots at a high resolution. Also, in a development apparatus using the single-component development method, an enormous strain is imposed on toner when a thin layer of toner is formed on a developing roller. Therefore, toner circulated in such a development apparatus deteriorates very quickly. As the toner deteriorates, the thin layer of toner formed on the developing roller becomes uneven. Because of this disadvantage, the single-component development method is generally not suitable for a high-speed and heavy-duty image forming apparatus.

Although a development apparatus using a hybrid development method (as disclosed in Japanese Patent Application Publication No. 3-100575) requires a larger number of parts and becomes lager than other types, it solves several problems mentioned above. However, a hybrid development method also has a disadvantage similar to that of the single-component development method. Therefore, even with a hybrid development method, it is difficult to develop fine dots evenly at a high resolution.

The development method as disclosed in Japanese Patent Application Publication No. 3-113474 may provide a high image quality constantly. However, the configuration of a development apparatus using such a development method may become complicated.

The development method as disclosed in Japanese Patent Application Publication No. 3-21967 is useful to achieve a high image quality on a small image forming apparatus. However, to obtain an intended result, formation of an electric field curtain and development of a latent image must be performed under limited conditions. In other words, if the conditions are not met, the disclosed method could degrade the image quality rather than improve it. In the development method as disclosed in Japanese Patent Application Publication No. 3-21967, toner hopping on a toner carrier is conveyed to a development area as the toner carrier rotates. On the other hand, in a development method as disclosed in Japanese Patent Application Publication No. 2002-341656, toner is conveyed to a development area solely by a hopping technique. However, the disclosed development method also has a similar program.

Meanwhile, in an image forming process where, for example, a first toner image, a second toner image, and a third toner image are formed in layers on a latent image carrier, succeeding toner images must be formed so as not to disturb preceding toner images. A non-contact type single-component development method or a toner cloud development method disclosed in Japanese Patent Application Publication No. 3-113474 makes it possible to form toner images of different colors in layers on a latent image carrier. However, in both of the methods, since alternating electric fields are formed between a latent image carrier and a developing roller, a part of toner of a preceding toner image on the latent image carrier may be removed when forming a succeeding toner image. This may disturb the preceding toner image and also cause toners of different colors to mix in a development apparatus. This problem has a severe impact on the quality of an image. One way to solve this problem is to perform a toner cloud development method without forming alternating electric fields between a latent image carrier and a developing roller.

The development methods disclosed in Japanese Patent Application Publication No. 3-21967 (patent document 1) and Japanese Patent Application Publication No. 2002-341656 may be used to implement such a toner cloud development method. However, as described above, the development methods disclosed in these patent documents produce desirable results only when they are performed under limited conditions. More specifically, if the conditions are not met, those methods may not be able to form a toner cloud. Also, even if a toner cloud is formed, a part of a toner layer formed on a latent image carrier in a preceding image development in an overlapping development process may be removed, enter a development apparatus used for a succeeding image development, and thereby cause toners of different colors to mix and disturb an image obtained in the preceding image development.

To obviate the above problems, an image forming apparatus according to an embodiment of the present invention is configured so that $V_{max}$ [V]/p [μm]>1 becomes true. Such an image forming apparatus makes it possible to constantly form a toner cloud. Thus, the above described embodiment provides a development apparatus and an image forming apparatus that are compact and able to provide a high image quality.

Also using a development method as disclosed in Japanese Patent Application Publication No. 2002-341656, where a latent image is developed by electrostatically carrying toner using alternating electric fields of three or more phases and without using mechanical movement of a toner carrier, together with a development apparatus in which Vmax [V]/p [μm] is true makes it possible to constantly form a toner cloud. However, in the development method disclosed in Japanese Patent Application Publication No. 2002-341656, if a small amount of toner is not appropriately conveyed for some reason and remains on a conveying base plate, toner accumulates around the remaining toner and degrades the quality of an image. Japanese Patent Application Publication No. 2004-286837 discloses a development apparatus that solves this problem. The disclosed development apparatus includes a fixed conveying base plate and a toner carrier configured to move above the surface of the conveying base plate. However, the disclosed development apparatus requires a very complicated mechanism. In an image forming apparatus according to an embodiment of the present invention, toner hopping between electrodes is carried to a development area as a toner carrier rotates. Such an image forming apparatus prevents toner accumulation described above and can be implemented with a simple mechanism.

Figure 7:
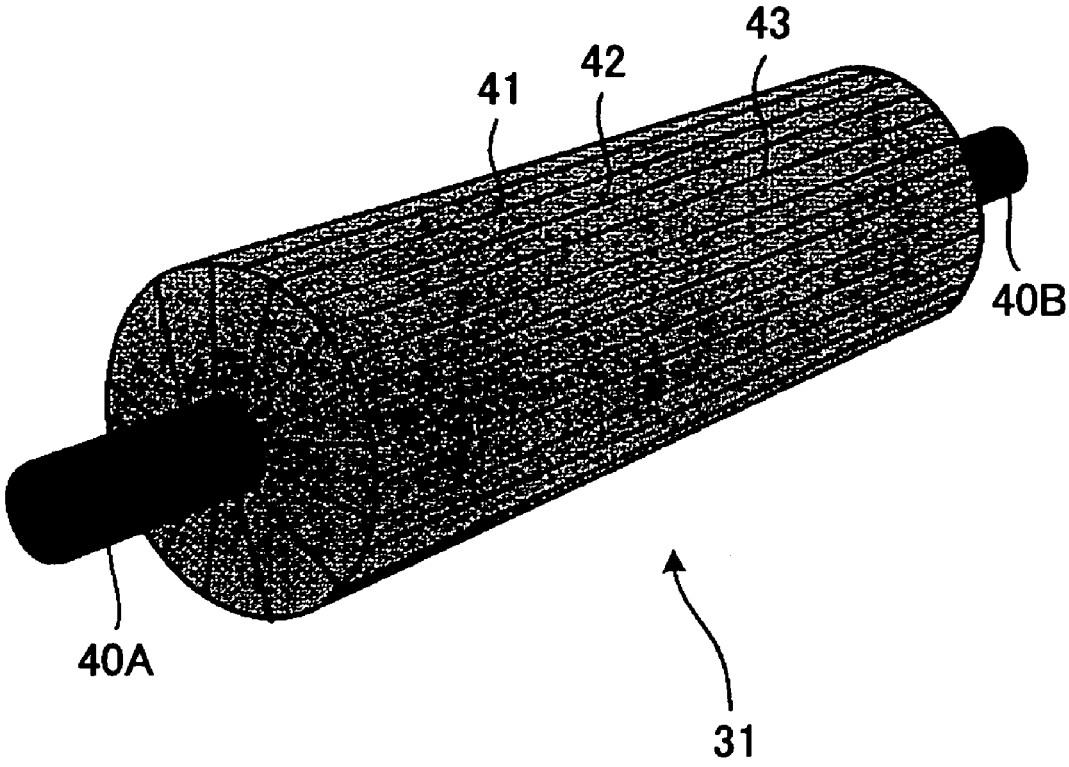
FIG. 7 is a perspective view of an exemplary toner carrier according to an embodiment of the present invention.

FIG. 7 is a perspective view of an exemplary toner carrier according to an embodiment of the present invention.

A toner carrier 31 shown in FIG. 7 is shaped like a roller and includes an electrode pattern made up of multiple electrodes 41 through n arranged at p μm pitch in the rotation direction. The odd numbered electrodes of the electrodes 41 through n are connected to an electrode axle 40A and the even numbered electrodes of the electrodes 41 through n are connected to an electrode axle 40B. The toner carrier 31 rotates around the electrode axles 40A and 40B. An alternating voltage as a bias potential is applied from an A/C power supply (not shown) via, for example, an electrode brush (not shown) to each of the electrode axles 40A and 40B.

Figure 15:
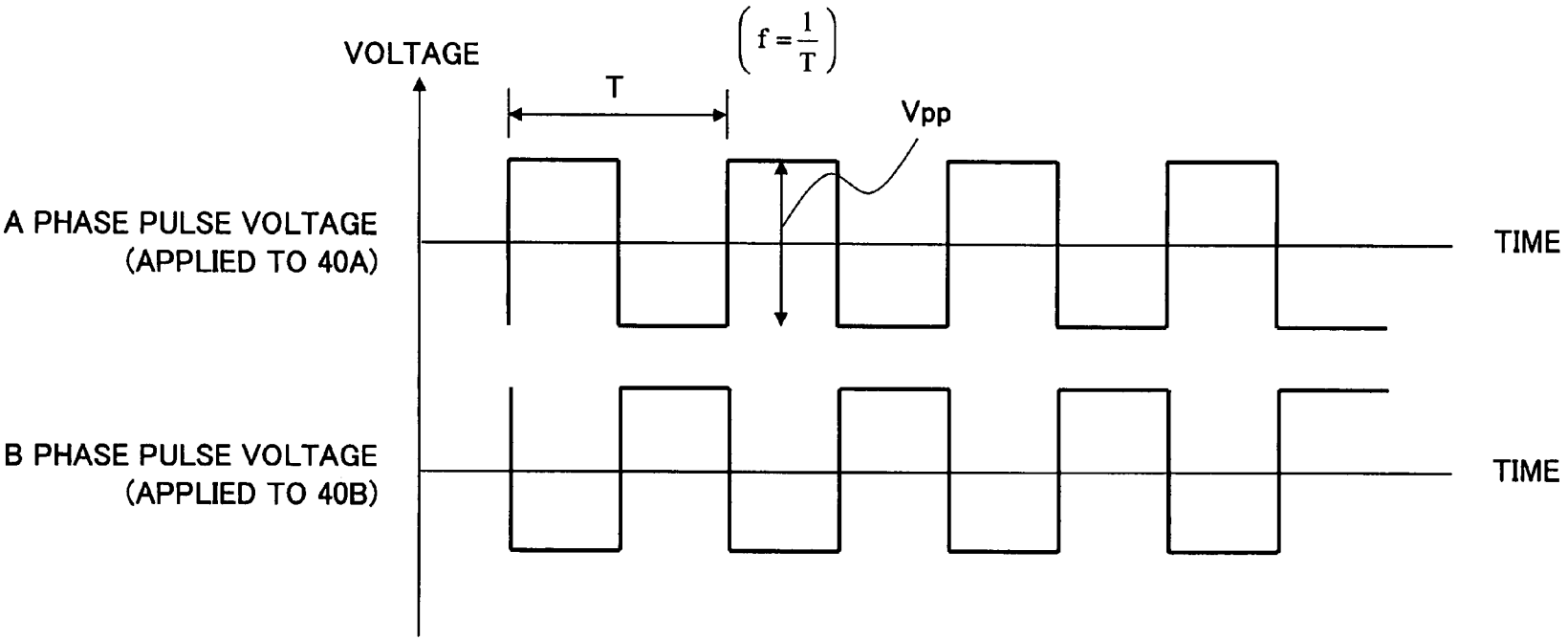
FIG. 15 is a waveform chart illustrating the characteristics of an A phase pulse voltage and a B phase pulse voltage applied to the exemplary toner carrier.
Figure 16:
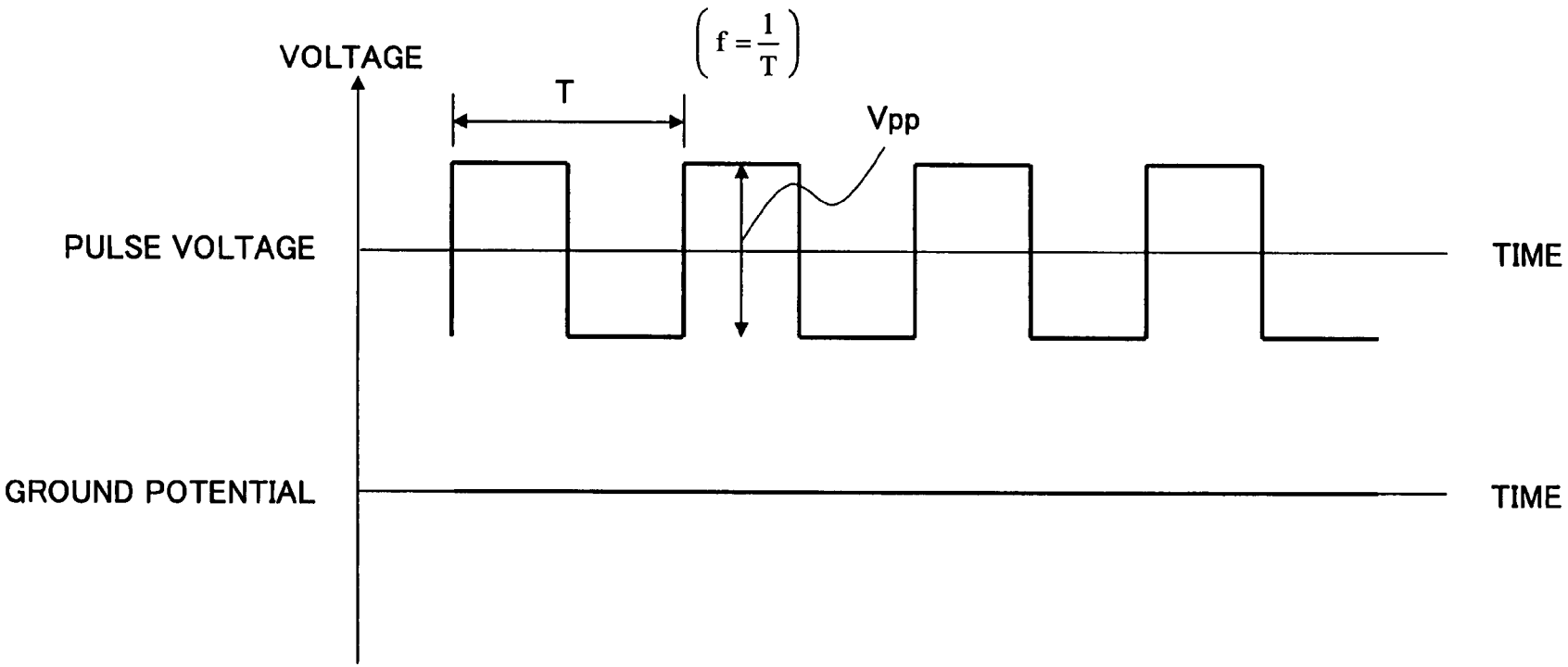
FIG. 16 is a waveform chart illustrating the characteristics of a pulse voltage applied to a toner carrier shown in patent document 1.

As shown in FIG. 15, an A phase pulse voltage of a rectangular wave is applied to the electrode axle 40A of the odd numbered electrodes and a B phase pulse voltage of a rectangular wave is applied to the electrode axle 40B of the even numbered electrodes. The A phase pulse voltage and the B phase pulse voltage are in opposite phases, but their average potentials (center of amplitude) per unit time are the same. The average potential corresponds to a development bias in the single-component development method and the two-component development method. Such pulse voltages in different phases generate a potential difference that is the same as the amplitude (Vpp) of each of the pulse voltages between an odd numbered electrode (a first electrode of a pair of electrodes) and an even numbered electrode (a second electrode of a pair of electrodes) in both the first and second halves of one cycle T. Compared with the voltage applying method shown in FIG. 16 that can generate a potential difference that is only a half of the amplitude, the voltage applying method shown in FIG. 15 makes it possible to generate a desired potential difference between electrodes using a pulse voltage having a smaller amplitude (Vpp). Therefore, the voltage applying method shown in FIG. 15 makes it possible to reduce scumming more effectively than with a conventional voltage applying method.

In FIG. 15, pulse voltages in opposite phases are applied to an odd numbered electrode and even numbered electrode. However, the two pulse voltages may not necessarily be in completely opposite phases. Even if the phase difference is less than half of a cycle, when the potential at one electrode is shifted in the plus direction from the center of the amplitude (Vpp), the potential at the other electrode may be shifted in the minus direction from the center of the amplitude. Using two pulse voltages in completely opposite phases, however, makes it possible to keep the potential difference between electrodes at the same value as the amplitude for a period of time longer than in other cases, and therefore is most preferable.

Figure 8A:
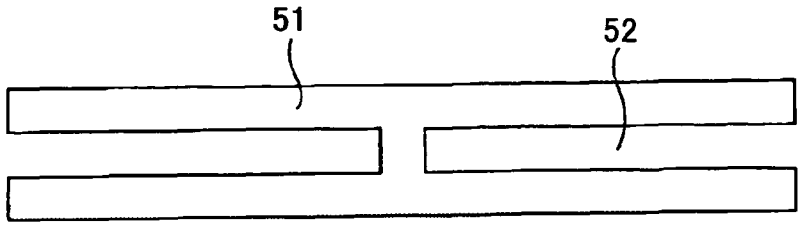
FIGS. 8A through 8C are drawings used to describe a part of an exemplary production process of the exemplary toner carrier.
Figure 8B:
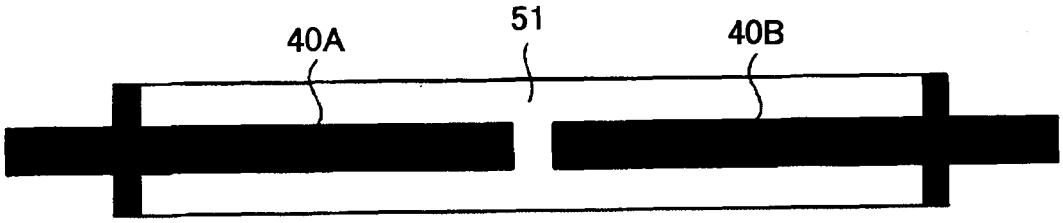
Figure 8C:
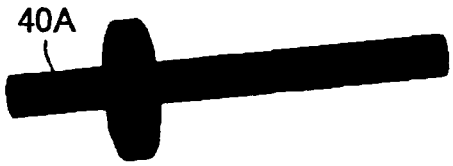
Figure 9A:
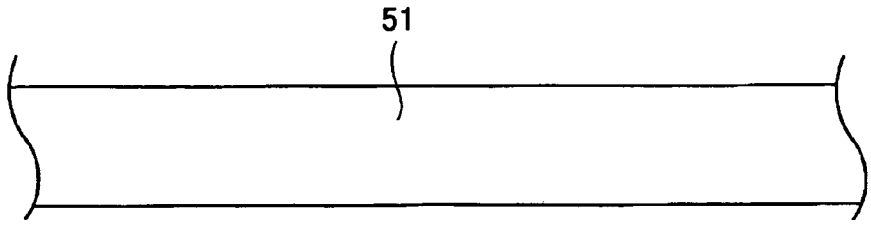
FIGS. 9A through 9E are drawings used to describe another part of the exemplary production process of the exemplary toner carrier.
Figure 9B:
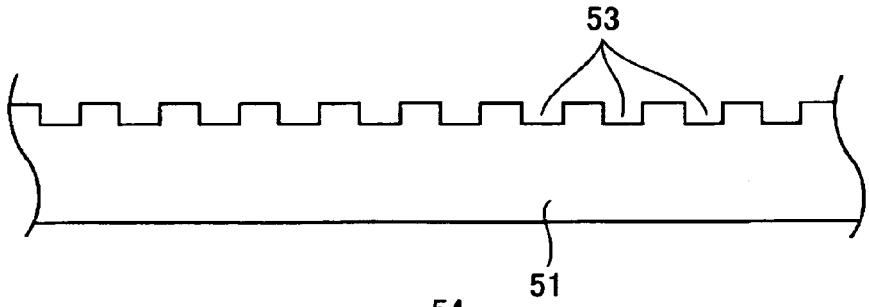
Figure 9C:
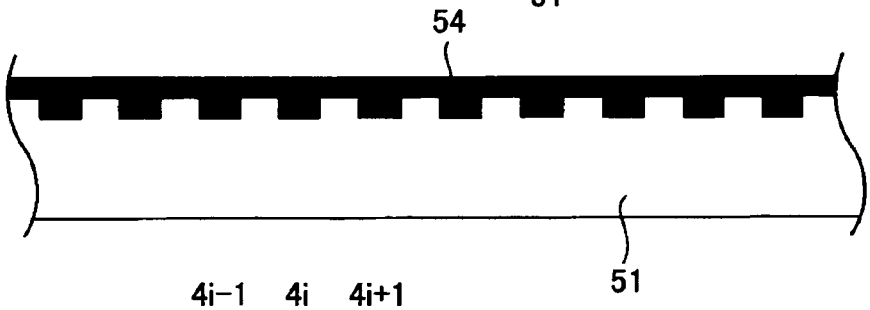
Figure 9D:
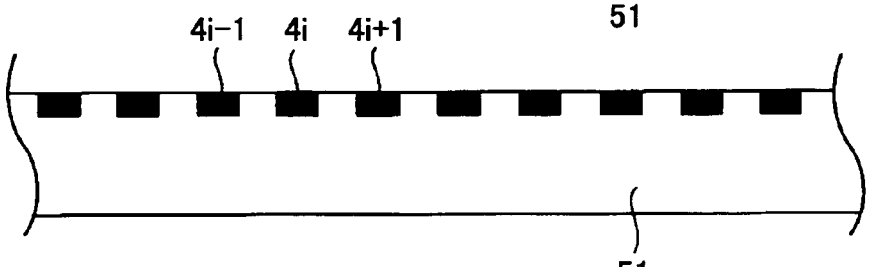
Figure 9E:
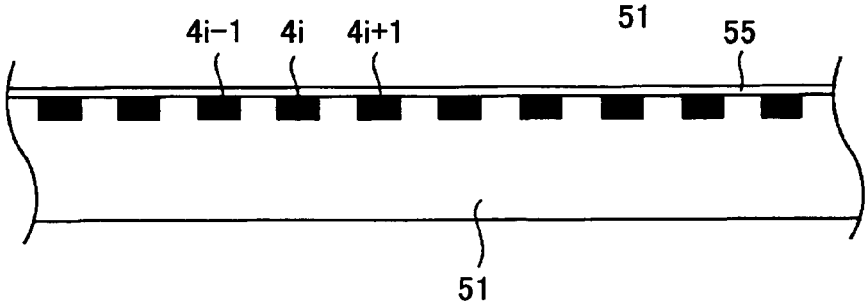
Figure 10:
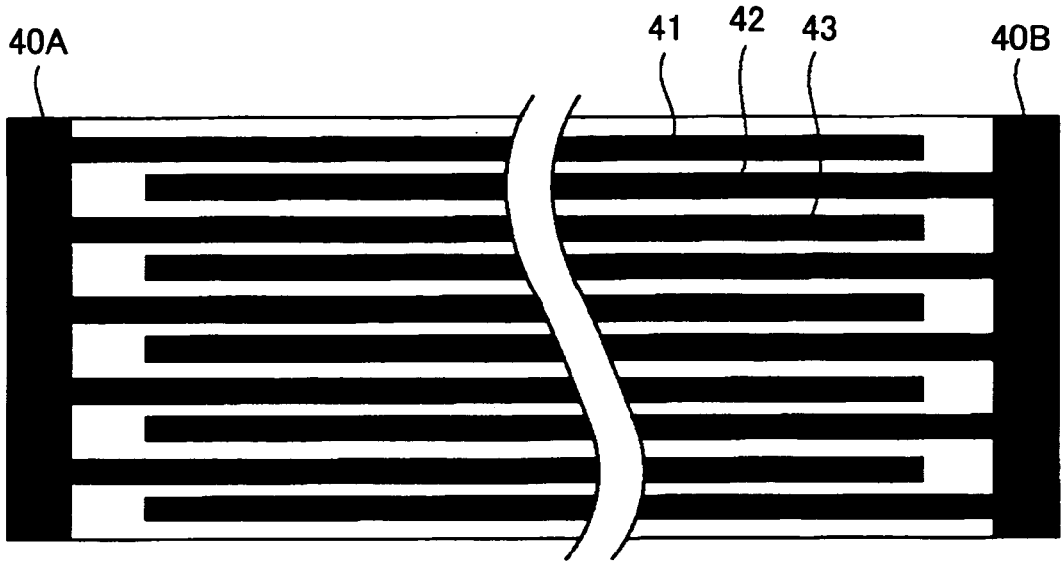
FIG. 10 is a drawing illustrating the exemplary toner carrier spread out flat.

As shown in FIGS. 8A through 8C, the toner carrier 31 includes a cylinder 51 made of an acrylic resin that is an insulator and the electrode axles 40A and 40B made of a stainless steel. The cylinder 51 has axle holes 52 into which the electrode axles 40A and 40B are inserted with force. The odd numbered electrodes (41, 43, . . . ) are connected to the electrode axle 40A and the even numbered electrodes (42, . . . ) are connected to the electrode axle 40B. FIGS. 9A through 9E are drawings used to describe the steps of forming the electrodes 41 through n. FIGS. 9A through 9E illustrate the surface of the toner carrier 31 seen in the direction along the rotation axis. In the step shown in FIG. 9A, the surface of the cylinder 51 is smoothed by turning it on a lathe. In the step shown in FIG. 9B, grooves 53 each having a width of 50 μm are formed at 100 μm pitch by carving the surface of the cylinder 51. In the step shown in FIG. 9C, an electroless nickel coating 54 is formed on the surface of the cylinder 51. In the step shown in FIG. 9D, the cylinder 51 is turned to remove unnecessary parts of the electroless nickel coating 54. At this stage, the electrodes 41 through n are formed in the grooves 53. The electrodes 41 through n are insulated from each other. In the step shown in FIG. 9E, a surface layer 55 (with a thickness of about 5 μm and a volume resistivity of about $10^{10}$ Ωcm) is formed by coating the surface of the cylinder 51 with a silicon resin to smooth the surface. FIG. 10 is a drawing illustrating the toner carrier 31 spread out flat.

A thin layer of toner is formed on the surface layer 55 of the toner carrier 31 as in the case of the base plate 4 shown in FIG. 1. When alternating voltages shown in FIG. 15 are applied as bias potentials to the electrode axles 40A and 40B from an A/C power supply (not shown) via electrode brushes (not shown), the toner on the surface layer 55 moves back and forth between the odd numbered electrodes (41, 43, . . . ) and the even numbered electrodes (42, . . . ) (a toner flare is formed). When Vmax [V] is the absolute value of the difference between a positive peak value and a negative peak value of the alternating voltage applied to the electrodes 41 through n, the toner flare starts to become active when Vmax [V]/p [μm] exceeds 1 and the toner flare becomes completely active when Vmax [V]/p [μm] exceeds 3. The volume resistivity of the surface layer 55 of the toner carrier 31 is preferably within the range between $10^9$ and $10^{12}$ Ωcm as in the case of the base plate 4. The surface layer 55 is preferably made of a silicon resin. As described above, the surface layer 55 is preferably made of a material that can positively charge toner through friction. For example, a glass material or a material used for coating the carriers of two-component developer is preferably used for the surface layer 55. Pitch p between each adjacent pair of the electrodes 41 through n is preferably smaller than a development gap d ($p<d$).

FIG. 11 is a schematic diagram of an exemplary image forming apparatus according to an embodiment of the present invention. The exemplary image forming apparatus includes a development apparatus including the toner carrier 31 described above. A magnetic brush of two-component developer 63 is brought into contact with the toner carrier 31 by a two-component developer unit 56. More specifically, the two-component developer 63, which is made by mixing magnetic carrier particles having a diameter of about 50 μm with 7-8 weight percent of polyester toner having a particle diameter of about 6 μm, is conveyed to the toner carrier 31 by a magnet sleeve 57 including a permanent magnet. A portion of the conveyed toner is transferred onto the toner carrier 31 by a direct bias potential applied between the magnetic sleeve 57 and the toner carrier 31. The toner transferred onto the toner carrier 31 forms a toner flare. The toner carrier is rotated by a driving unit (not shown) and, as a result, the toner is conveyed to a position facing a latent image carrier 58. The potential difference between the surface of the toner carrier 31 and the surface of the latent image carrier 58 causes the toner to be attracted to an electrostatic latent image on the latent image carrier 58. As a result, the electrostatic latent image is developed and a toner image is formed. Alternating voltages as bias potentials are applied to the electrode axles 40A and 40B of the toner carrier 31 from an A/C power supply 59 using, for example, electrode brushes. The applied alternating voltages form a periodic potential difference between the odd numbered electrodes (41, 43, . . . ) and the even numbered electrodes (42, . . . ).

Toner that has not been used for image development is returned to the magnet sleeve 57. Since a toner flare is formed, the adhesive force of the toner to the toner carrier 31 is very weak. Therefore, the toner on the toner carrier 31 can be easily scraped or smoothed by the magnetic brush of the two-component developer 63 on the rotating magnet sleeve 57. Through the above process, a substantially constant amount of toner flare is maintained on the toner carrier 31. In a container 60 of the two-component developer unit 56, the two-component developer 63 is conveyed while being agitated. The magnet sleeve 57 conveys a portion of the two-component developer 63 to the toner carrier 31 and retrieves toner not used for image development from the toner carrier 31.

In this embodiment, an organic photoconductor with a thickness of 13 μm is used for the latent image carrier 58 and a 1200 dpi laser writing unit (not shown) is used to form a latent image on the latent image carrier 58. The latent image carrier 58 is rotated by a driving unit (not shown) and evenly charged by a charging unit (not shown). The laser writing unit exposes the latent image carrier 58 to form an electrostatic latent image. The potential on the surface of the latent image carrier 58 is preferably between −300 and −500 V. The potential of an area where a solid-color latent image is formed is preferably between 0 and −50 V.

The electrostatic latent image is developed by a toner flare on the toner carrier 31 and a toner image is formed. In this embodiment, toner with a particle diameter of about 6 μm is used. The amount of charge of the toner is about −22 μC/g. To form an image with no scumming, to form a smooth solid-color image, and to accurately form dots at 1200 dpi with the toner mentioned above, the gap between the toner carrier 31 and the latent image carrier 58 is preferably about 500 μm, and alternating biases having an average potential of −200 V at each instant, peak potentials of −400 V and 0 V, and a frequency of 5 kHz are preferably applied to the odd numbered electrodes and the even numbered electrodes of the toner carrier 31 from the A/C power supply 59 (alternating biases applied to the odd numbered electrodes and the even numbered electrodes are in opposite phases).

The toner image on the latent image carrier 58 is transferred onto a recording medium such as recording paper fed from a paper feeding unit (not shown), the transferred toner image is fused onto the recording medium by a fusing unit (not shown), and then the recording medium is ejected.

If an excessive amount of toner is on the toner carrier 31, the charge of the toner shields the electric field curtain and thereby prevents formation of a toner flare. Therefore, a direct bias of about 200 V is preferably applied between the magnet sleeve 57 and the toner carrier 31 from the A/C power supply 59 so that the amount of toner per unit area on the toner carrier 31 is maintained at around 0.2 mg/cm$^2$. Since toner is spread by a toner flare, slight unevenness of the toner transferred from the magnet sleeve 57 to the toner carrier 31 may not cause a major problem. Therefore, it may not be necessary to superpose an AC bias on the direct bias or to make the magnetic brushes of a two-component developer exactly even.

When the amount of toner required to form a solid-color image on the latent image carrier 58 is 0.4 mg/cm$^2$, the rotational speed of the toner carrier 31 is preferably at least two times faster than that of the latent image carrier 58 to prevent toner shortage. In this embodiment, the rotational speed of the toner carrier 31 is 2.5 times faster than that of the latent image carrier 58. The toner carrier 31 and the latent image carrier 58 are rotated in opposite directions in FIG. 11, but may be rotated in the same direction. The magnet sleeve 57 and the toner carrier 31 are preferably rotated in the same direction as shown in FIG. 11 so that returned toner can be efficiently retrieved by the magnet sleeve 57.

The exemplary image forming apparatus as described above makes it possible to form an image with no scumming, to form a smooth solid-color image, and to accurately form a dot at 1200 dpi.

In an exemplary image forming apparatus according to an embodiment of the present invention, toner the base resin (primary component) of which is made of polyester or styrene acrylate is used. Normal charge polarity of the toner is negative. In the exemplary image forming apparatus, an evenly charged area (non-image area) and a latent image area of the latent image carrier 58 are charged to the same polarity as the normal charge polarity (negative) of the toner. A latent image is developed by using a reversal development method in which toner is caused to selectively adhere to the latent image area with a potential lower than that of the non-image area.

The cylindrical toner carrier 31 shown in FIG. 11 includes the glass base plate 1, the electrodes 21 through 2*n*, and the surface layer 3 for covering the electrodes 21 through 2*n* as shown in FIG. 1. The surface layer 3 is made of a material that charges toner hopping on the toner carrier 31 to the normal charge polarity (negative in this embodiment) of the toner by friction with the toner. In other words, the toner is in a lower position in the negative range of the frictional charge order than the surface layer 3. As a material of the surface layer 3 having the above characteristics, the following may be used: an organic material such as silicone, nylon, melamine resin, acrylic resin, PVA, or urethane; quaternary ammonium salt or nigrosine dye; a metallic material such as Ti, Sn, Fe, Cu, Cr, Ni, Zn, Mg, or Al; or an inorganic material such as $TiO_2$, $SnO_2$, $Fe_2O_3$, $Fe_3O_4$, CuO, $Cr_2O_3$, NiO, ZnO, MgO, or $Al_2O_3$.

The above materials may be used individually or in combination.

In the exemplary image forming apparatus including the toner carrier 31 having the surface layer 3 as described above, the surface layer 3 charges toner hopping on the toner carrier 31 to the normal charge polarity of the toner by friction with the toner. Also, charging of toner by friction with the surface layer 3 to the polarity opposite to the normal charge polarity is prevented. This mechanism prevents the amount of charge (of normal charge polarity) of hopping toner from decreasing and thereby prevents development problems caused by irregular toner hopping.

Toner with a positive normal charge polarity may also be used. In this case, a material that charges toner positively by friction with the toner may be used for the surface layer 3.

The frictional charge order of toner is determined after adding additives such as silica and titanic oxide to the base resin (particles) of toner. The frictional charge order of toner may be determined as described below. First, toner is rubbed against the surface layer 3 for a specific period of time, and then sampled by suction. The amount of charge of the sampled toner is measured using an electrometer. If the result indicates an increase in the amount of negative charge of the toner, the toner is in a lower position in the negative range of the frictional charge order than the surface layer 3. If the result indicates an increase in the amount of positive charge of the toner, the toner is in a higher position in the positive range of the frictional charge order than the surface layer 3.

Figure 12:
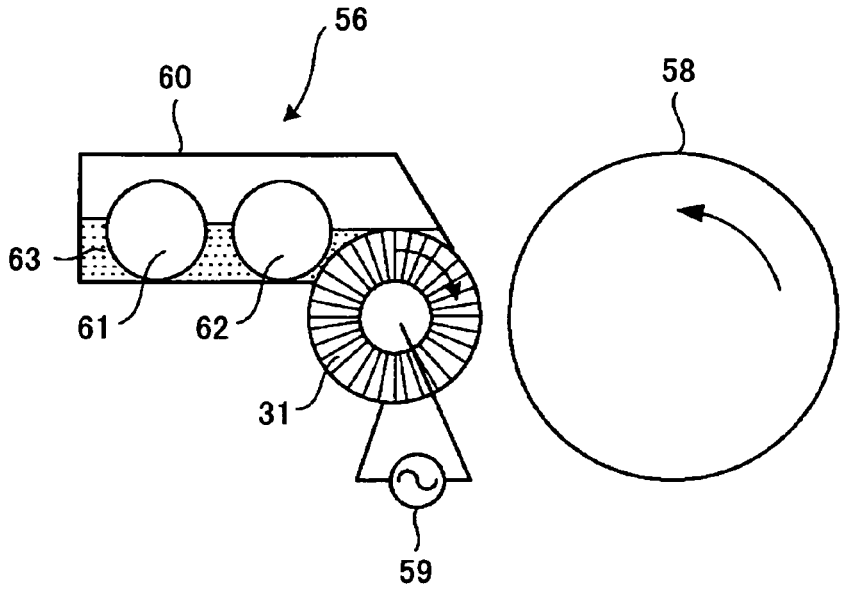
FIG. 12 is a schematic drawing of an exemplary image forming apparatus according to another embodiment of the present invention.

FIG. 12 is a schematic diagram of an exemplary image forming apparatus according to another embodiment of the present invention. Unlike the exemplary image forming apparatus shown in FIG. 11, a two-component developer unit 56 of the exemplary image forming apparatus shown in FIG. 12 does not include the magnet sleeve 57. Toner is supplied to a toner carrier 31 by cascade development of two-component developer. Since the two-component developer unit 56 shown in FIG. 12 forms a thin layer of toner on the toner carrier 31 using a simple cascade, the toner transfer efficiency is lower than that of the two-component developer unit 56 shown in FIG. 11. To compensate for the low toner transfer efficiency, the rotational speed of the toner carrier 31 is increased to meet the development speed on a latent image carrier 58. The exemplary development apparatus shown in FIG. 12 includes the two-component developer unit 56 and the toner carrier 31, and does not include the magnet sleeve 57. A development apparatus with such a configuration can be made as small as a conventional two-component developer unit and therefore makes it possible to provide an image forming engine that is compact and able to produce a high-quality image.

The above described embodiment provides a development apparatus and an image forming apparatus that are compact and able to provide high image quality.

Figure 13:
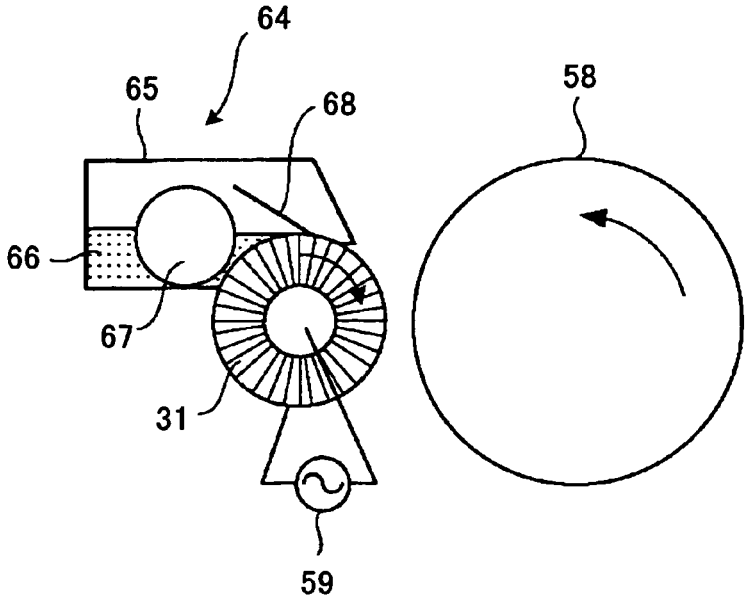
FIG. 13 is a schematic drawing of an exemplary image forming apparatus according to another embodiment of the present invention.

FIG. 13 is a schematic diagram of an exemplary image forming apparatus according to another embodiment of the present invention. The exemplary image forming apparatus shown in FIG. 13 includes a single-component developer unit 64 instead of the two-component developer unit 56 shown in FIG. 12. The single-component developer unit 64 uses toner with no carrier particles. Toner 66 in a container 65 of the single-component developer unit 64 is agitated and circulated by a circulating paddle 67 and supplied to the toner carrier 31. The toner on the toner carrier 31 is smoothed by a metering blade 68 used as a toner controlling part to form a thin layer of toner with a uniform thickness.

Although the single-component developer unit 64 may be less efficient in supplying toner to the toner carrier 31 than the two-component developer units 56 shown in FIG. 11 and FIG. 12, it is not a critical issue under certain conditions. One advantage of the single-component developer unit 64 is that it makes it possible to provide a development apparatus that is very compact, light, and able to produce a high quality image.

The above described embodiment provides a development apparatus and an image forming apparatus that are compact and able to provide a high image quality.

Figure 14:
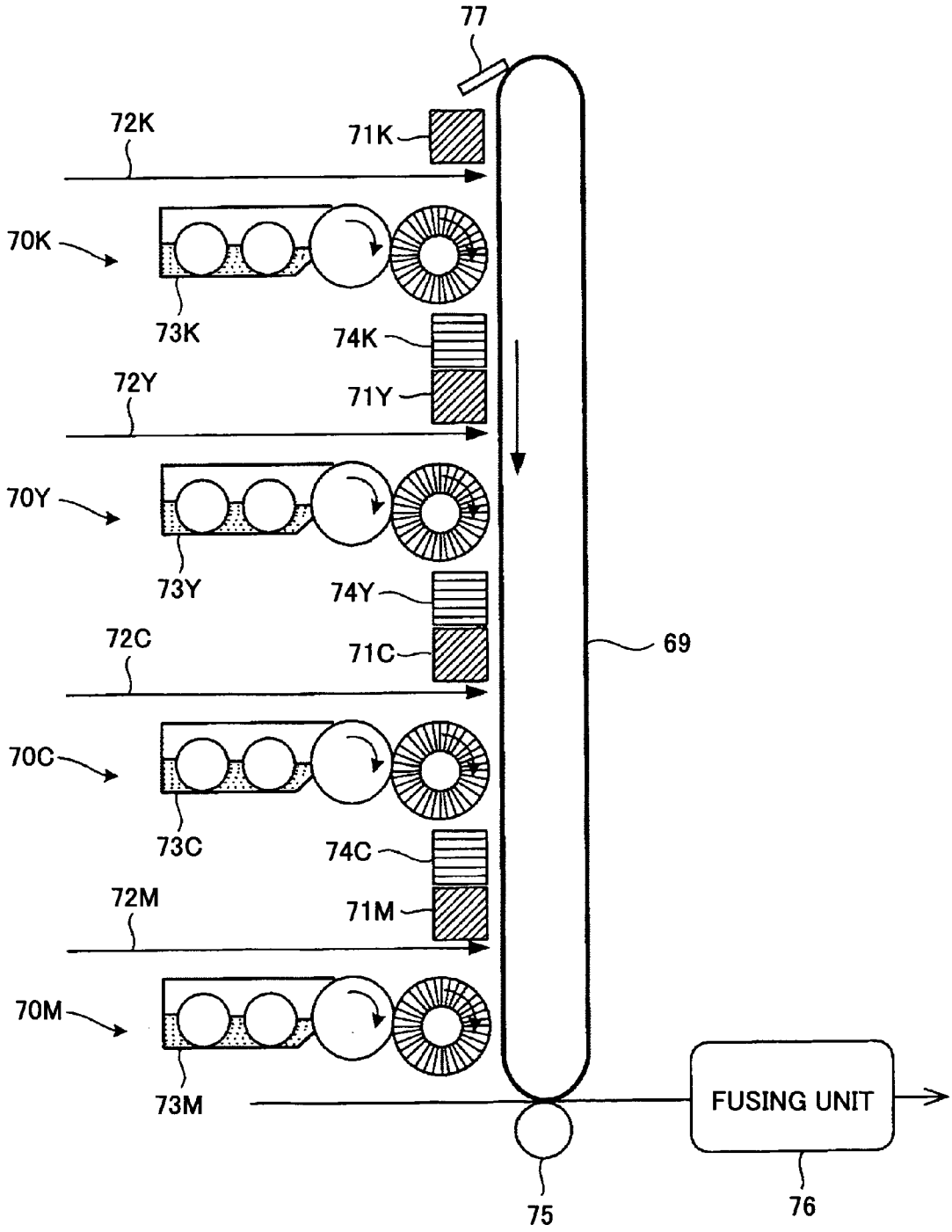
FIG. 14 is a schematic drawing of an exemplary image forming apparatus according to still another embodiment of the present invention.

FIG. 14 is a schematic diagram of an exemplary image forming apparatus according to still another embodiment of the present invention. The exemplary image forming apparatus shown in FIG. 14 includes multiple development apparatuses each having substantially the same configuration as that of the development apparatus (that includes the two-component developer unit 56 and the toner carrier 31) shown in FIG. 11. The exemplary image forming apparatus forms a color image by forming toner images of different colors in layers on an organic photoconductor 69 shaped like a belt. The organic photoconductor 69 is stretched between two rollers (not shown) and rotated by a driving unit (not shown).

To the left of the organic photoconductor 69, image forming units 70K, 70Y, 70C, and 70M for forming toner images of different colors, for example, black, yellow, cyan, and magenta, are arranged. A charging unit 71K of the image forming unit 70K uniformly charges the organic photoconductor 69; a writing unit (not shown) used as an exposing unit exposes the organic photoconductor 69 with a light beam 72K modulated by black image data to form an electrostatic latent image; and a development apparatus 73K, which has substantially the same configuration as that of the development apparatus (that includes the two-component developer unit 56 and the toner carrier 31) shown in FIG. 11, develops the electrostatic latent image and thereby forms a black toner image. Then, a discharger 74K discharges the organic photoconductor 69 as a preparation for the next image forming operation.

Next, a charging unit 71Y of the image forming unit 70Y uniformly charges the organic photoconductor 69; a writing unit (not shown) used as an exposing unit exposes the organic photoconductor 69 with a light beam 72Y modulated by yellow image data to form an electrostatic latent image; and a development apparatus 73Y, which has substantially the same configuration as that of the development apparatus (that includes the two-component developer unit 56 and the toner carrier 31) shown in FIG. 11, develops the electrostatic latent image and thereby forms a yellow toner image on the black toner image. Then, a discharger 74Y discharges the organic photoconductor 69 as a preparation for the next image forming operation.

Next, a charging unit 71C of the image forming unit 70C uniformly charges the organic photoconductor 69; a writing unit (not shown) used as an exposing unit exposes the organic photoconductor 69 with a light beam 72C modulated by cyan image data to form an electrostatic latent image; and a development apparatus 73C, which has substantially the same configuration as that of the development apparatus (that includes the two-component developer unit 56 and the toner carrier 31) shown in FIG. 11, develops the electrostatic latent image and thereby forms a cyan toner image on the yellow toner image and the black toner image. Then, a discharger 74C discharges the organic photoconductor 69 as a preparation for the next image forming operation.

Next, a charging unit 71M of the image forming unit 70M uniformly charges the organic photoconductor 69; a writing unit (not shown) used as an exposing unit exposes the organic photoconductor 69 with a light beam 72M modulated by magenta image data to form an electrostatic latent image; and a development apparatus 73M, which has substantially the same configuration as that of the development apparatus (that includes the two-component developer unit 56 and the toner carrier 31) shown in FIG. 11, develops the electrostatic latent image and thereby forms a magenta toner image on the cyan toner image, the yellow toner image, and the black toner image. As a result, a full color toner image is formed.

A paper feeding unit (not shown) feeds a recording medium such as recording paper; a transfer roller 75, to which a transfer bias is applied from a power supply, transfers the full color toner image onto the recording medium; and a fusing unit 76 fuses the full color image onto the recording medium. Then, the recording medium is ejected. After the full color image is transferred onto the recording medium, remaining toner on the organic photoconductor 69 is removed by a cleaner 77.

For each of the development apparatuses 73K, 73Y, 73C, and 73M, a development apparatus including the two-component developer unit 56 and the toner carrier 31 shown in FIG. 12 or a development apparatus including the single-component development apparatus 64 and the toner carrier 31 shown in FIG. 13 may also be used.

In the exemplary image forming apparatus of the above embodiment, toner images of four different colors are formed on the same organic photoconductor 69. Because of this mechanism, unlike in an apparatus using a conventional 4-drum tandem method, misalignment of images hardly occurs. Therefore, the above embodiment makes it possible to provide a development apparatus and an image forming apparatus that can accurately form toner images of different colors on a latent image carrier and thereby form a high quality full color image. The exemplary image forming apparatus shown in FIG. 14 is configured so that Vmax [V]/p [μm]>1 and p [μm]<d [μm] become true at the same time. A development apparatus with such a configuration does not disturb preceding toner images formed on the organic photoconductor 69 and the toner of the preceding toner images does not come off and enter a development apparatus used to develop a succeeding toner image. Therefore, the above embodiment makes it possible to provide a development apparatus that obviates problems such as scavenging and toner mixing and is able to produce a high-quality image.

According to embodiments of the present invention, pulse voltages in different phases are applied to each adjacent pair of the odd numbered electrodes and the even numbered electrodes. Therefore, when the potential at one electrode is shifted in the plus direction from the center of the amplitude (Vpp), the potential at the other electrode may be shifted in the minus direction from the center of the amplitude. Such a voltage applying method makes it possible to generate a potential difference between electrodes which potential difference is larger than half of the amplitude of each of the pulse voltage. Compared with a method in which a pulse voltage is applied to only one of each pair of adjacent electrodes, the voltage applying method as described above makes it possible to generate a desired potential difference between electrodes using a pulse voltage having a smaller amplitude (Vpp).

The present invention is not limited to the specifically disclosed embodiments, and variations and modifications may be made without departing from the scope of the present invention.

The present application is based on Japanese Priority Application No. 2005-299082 filed on Oct. 13, 2005 and Japanese Priority Application No. 2006-266496 filed on Sep. 29, 2006, the entire contents of which are hereby incorporated herein by reference.

What is claimed is:

1. An apparatus for developing a latent image with developing material on a latent image carrier, comprising:

a toner carrier coated with a surface layer;

multiple electrodes arranged at intervals on a surface of the toner carrier;

a metering blade for controlling a thinness of the developing material including a toner layer on the toner carrier;

a potential difference is formed between even-numbered electrodes and odd-numbered electrodes of said electrodes by applying a first pulse voltage to the even-numbered electrodes and a second pulse voltage to the odd-numbered electrodes so that toner on the surface of the toner carrier moves back and forth between said electrodes, where the first pulse voltage and the second pulse voltage are in different phases, the toner moving back and forth between said electrodes is conveyed to a position facing the latent image carrier by movement of the surface of the toner carrier and thereby is caused to adhere to the latent image on the latent image carrier, and when a pitch between said electrodes is p μm and a distance between the toner carrier and the latent image carrier is d μm, p μm<d μm in order to reduce a transfer of toner from the latent image carrier to the toner carrier;

wherein the developing material contains toner but no carrier particles, and wherein the surface layer of the toner carrier includes a material to charge the toner to a normal charge polarity of the toner by friction with the toner.

2. The apparatus as claimed in claim 1, wherein the first pulse voltage and the second pulse voltage are in opposite phases.

3. The apparatus as claimed in claim 1, wherein, when a maximum value of the potential difference is Vmax volts, Vmax/p μm>1 volt/μm.

4. The apparatus as claimed in claim 1, wherein the toner carrier is shaped like a roller and includes two rotation axles; the odd numbered electrodes are connected to one of the two rotation axles; and the even numbered electrodes are connected to the other one of the two rotation axles.

5. The apparatus as claimed in claim 1, further comprising:

a toner-layer forming unit configured to form a layer of charged toner on the surface of the toner carrier.

6. An image forming apparatus including the apparatus as claimed in claim 1.

7. An image forming apparatus including two or more of the apparatuses as claimed in claim 1, wherein two or more toner images of different colors are formed in layers on one latent image carrier by the two or more of the apparatuses.

8. The apparatus of claim 1, wherein the developing material containing no carrier particles results in smaller more compact light-weight devices.

9. The apparatus as claimed in claim 1, wherein the material is positively charged relative to the toner.

10. The apparatus as claimed in claim 9, wherein the material is resin.

11. The apparatus as claimed in claim 1, wherein the material is one of silicone, nylon, melamine resin, acrylic resin, PVA, urethane, quaternary ammonium salt, nigrosine dye, Ti, Sn, Fe, Cu, Cr, Ni, Zn, Mg, Al, $TiO_2$, $SnO_2$, $Fe_2O_3$, $Fe_3O_4$, CuO, $Cr_2O_3$, NiO, ZnO, MgO, and $Al_2O_3$.

12. The apparatus as claimed in claim 1, wherein the material is silicon resin.

13. A method of developing a latent image on a latent image carrier with developing material, the developing material containing toner but no carrier particles, comprising:

forming a toner layer on a toner carrier having multiple electrodes arranged at intervals on a surface thereof, a surface layer of the toner carrier including a material to charge toner to an normal charge polarity of the toner by friction with the toner, a pitch between the electrodes being p μm, a distance between the toner carrier and latent image carrier being d μm, and p μm<d μm, thereby reducing a transfer of toner from the latent image carrier to the toner carrier;

controlling a thinness of the toner layer on the toner carrier;

forming a potential difference between even-numbered electrodes and odd-numbered electrodes of said electrodes by applying a first pulse voltage to the even-numbered electrodes and a second pulse voltage to the odd-numbered electrodes, and thereby causing toner on the surface of the toner carrier to move back and forth between said electrodes, where the first pulse voltage and the second pulse voltage are in different phases and the toner contains no carrier particles; and conveying the toner moving back and forth between said electrodes to a position facing the latent image carrier by moving the surface of the toner carrier, thereby causing the toner to adhere to the latent image on the latent image carrier.

14. The method of claim 13, further comprising:

forming the toner layer by simple cascade; and increasing rotational speed of the toner carrier, thereby reducing scumming.

15. The method of claim 13, further comprising:

measuring unwanted toner transfer in an overlapping development process by observing any increase in optical density.

16. The method of claim 13, further comprising:

calibrating the p and d so as to eliminate any increase in optical density.

17. The method of claim 13, further comprising:

forming an electrical field curtain on the toner carrier so that the electrical field curtain does not affect an electric field of a toner image on a latent image carrier.

18. The method of claim 13, wherein the forming forms a toner layer on the toner carrier including the material which is positively charged relative to the toner.

19. The method of claim 13, wherein the forming forms a toner layer on the toner carrier including the material which is one of silicone, nylon, melamine resin, acrylic resin, PVA, urethane, quaternary ammonium slat, nigrosine dye, Ti, Sn, Fe, Cu, Cr, Ni, Zn, Mg, Al, $TiO_2$, $SnO_2$, $Fe_2O_3$, $Fe_3O_4$, CuO, $Cr_2O_3$, NiO, ZnO, MgO, and $Al_2O_3$.

20. The method of claim 13, wherein the forming forms a toner layer on the toner carrier including the material which is silicon resin.

* * * * *